United States Patent [19]

Piller et al.

[11] Patent Number: 4,917,515

[45] Date of Patent: Apr. 17, 1990

[54] INKING RIBBON CASSETTE

[75] Inventors: Gerhard Piller, Allensbach; Michael Schwarzbauer, Constance, both of Fed. Rep. of Germany

[73] Assignee: Computer Gesellschaft Konstanz mbH, Bundesrepublik, Fed. Rep. of Germany

[21] Appl. No.: 249,837

[22] Filed: Sep. 27, 1988

[30] Foreign Application Priority Data

Sep. 28, 1987 [DE] Fed. Rep. of Germany ... 8713034[U]

[51] Int. Cl.[4] ..... B41J 32/00

[52] U.S. Cl. ..... 400/249; 400/208; 400/235.1; 400/703

[58] Field of Search ..... 400/207, 209, 249, 235.1, 400/243, 703, 208, 208.1

[56] References Cited

U.S. PATENT DOCUMENTS

| | | | |
|---|---|---|---|
| 4,307,969 | 12/1981 | Daughters | 400/243 X |
| 4,400,103 | 8/1983 | Daughters | 400/243 X |
| 4,650,357 | 3/1987 | Sidvers et al. | 400/208 |
| 4,669,899 | 6/1987 | Kawakami | 400/208 X |
| 4,773,776 | 9/1988 | Gomoll et al. | 400/243 X |
| 4,790,675 | 12/1988 | Saati | 400/243 X |
| 4,790,677 | 12/1988 | Kress | 400/249 |
| 4,810,166 | 3/1989 | Schulze et al. | 400/249 X |

FOREIGN PATENT DOCUMENTS

| | | | |
|---|---|---|---|
| 047685 | 3/1982 | Japan | 400/208 |
| 190380 | 9/1985 | Japan | 400/208 |
| 217193 | 10/1985 | Japan | 400/208 |
| 219081 | 11/1985 | Japan | 400/208 |
| 255470 | 12/1985 | Japan | 400/208 |

*Primary Examiner*—Edgar S. Burr
*Assistant Examiner*—Ren Yan
*Attorney, Agent, or Firm*—Hill, Van Santen, Steadman & Simpson

[57] ABSTRACT

A symmetrically constructed inking ribbon cassette is provided that is substantially rectangular in shape and which has two openings symmetrically arranged at the shorter sides of the cassette for receiving capstan drive shaft and a light barrier. The cassette housing is formed of two halves which are held together with catch noses at a joining plane of the housing halves and a viewing slot is provided in each slot adjacent to one of the ribbon winding hubs which are carried in the housing.

4 Claims, 1 Drawing Sheet

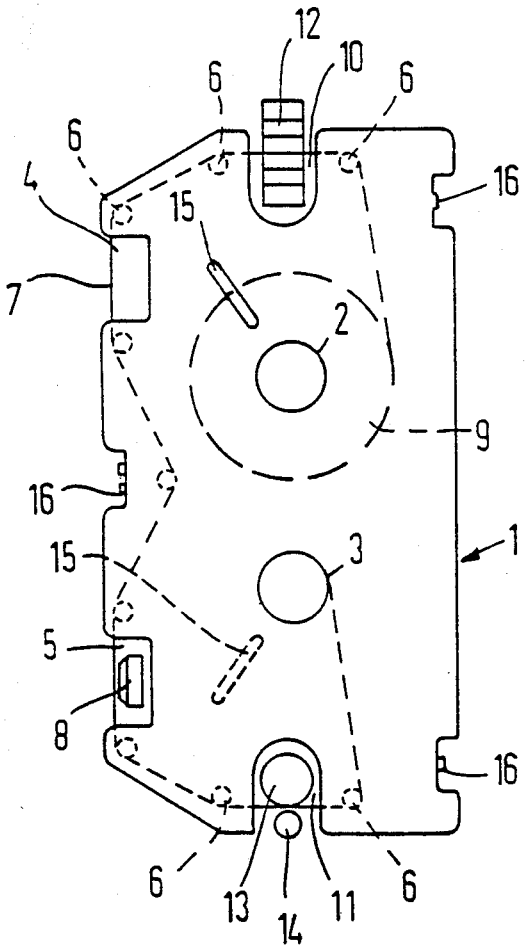
12
10
6
6
6
4
15
16
7
2
9
16
15
3
1
5
8
16
6
13
14
11
6

INKING RIBBON CASSETTE

BACKGROUND OF THE INVENTION

The invention is directed to an inking ribbon cassette comprising a shaft-like housing composing two halves and comprising two ribbon winding hubs between which the inking ribbon is conveyable along a longitudinal edge past two openings arranged symmetrically relative to the center line between the two ribbon winding hubs, said openings being provided for a printer head introducible therebehind, being conveyable by means of a capstan drive shaft dipping through a further opening into the cassette.

A number of different inking ribbon cassettes comprising two ribbon winding hubs are known wherein the inking ribbon is rewound from a ribbon winding hub carrying the supply reel onto a take-up hub, being rewound passing the printer head. Dependent on the printing system, such inking ribbon cassettes are employable either in a single use or in a multi-use mode. In multi-use mode, the cassette is turned after every run-through of the ribbon, so that the inking ribbon is transported in reverse direction during the next run-through. Such turnover cassettes must therefore be constructed such that printer head and capstan drive shaft encounter appropriate openings in the cassette both in the first as well as in the second turned position.

SUMMARY OF THE INVENTION

An object of the present invention is to fashion an inking ribbon cassette for multiple use such that it can be simply realized in terms of its structural format and nonetheless allows certain variation possibilities for various functions.

This object is inventively achieved wherein two openings arranged mirror-symmetrically relative to one another and extending into the conveying path of the inking ribbon are provided at each of the two narrow sides of the inking ribbon cassette, said openings being for the capstan drive shaft on the one hand and for a light barrier that monitors the end of the ribbon, on the other hand.

BRIEF DESCRIPTION OF THE DRAWINGS

The invention shall be set forth in greater detail below with reference to the drawing which is a plan view of an inking ribbon cassette embodying the principles of the present invention.

DESCRIPTION OF THE PREFERRED EMBODIMENTS

The figure thereby shows a substantially rectangular inking ribbon cassette 1 that is composed of two identically fashioned housing shells and contains two ribbon winding hubs 2, 3, that can be plugged onto two drive arbors. The cassette has two longitudinal edges and two shorter lateral edges. Two openings 4, 5 symmetrically arranged relative to the center line between the two ribbon winding hubs are provided at one longitudinal edge, the inking ribbon 7 multiply deflected via rollers 6 being moved past these openings 4, 5. The inking ribbon 7 is thereby unwound from the ribbon winding hub 2 that carries the supply reel 9 and is wound onto the ribbon winding hub 3. The roughly rectangular openings 4, 5 are selected of such a size that, as may be seen with reference to the opening 5, a printer head 8 can dip or extend into the inking ribbon cassette 1 behind the inking ribbon 7. At its two shorter edges, the inking ribbon cassette 1 further comprises respective, roughly U-shaped openings 10, 11 into which, first, a light barrier 12 and, second, a capstan drive roller 13 dip when the inking ribbon cassette 1 is introduced into a printer device. Together with a cooperating roller 14, the capstan drive shaft 13 sees to the transport of the ribbon 7, whereby a slip clutch in the capstan drive shaft 13 effects that the inherently higher inking ribbon speed is adapted to the lower conveying speed of the printable document moving past the printer head 8. The drive for the ribbon winding hub 3 coupled to the drive of the capstan drive shaft 13 is likewise set such with a slip clutch that only a slight drive torque derives for the ribbon winding hub 3. The end of the ribbon is monitored with the light barrier 12 provided in the opening 10, whereby the position of the light barrier 12 relative to the printer head 8 is selected such that, given a report of an end of ribbon, all documents situated on the path to the printing station can still be printed before the end of the ribbon reaches the printer head 8. As soon as the inking ribbon has been completely rewound onto the ribbon winding hub 3, the inking ribbon cassette 1 can be turned over, whereby the printer head 8 dips into the opening 4, the capstan drive shaft 13 dips into the opening 10 and the light barrier 12 dips into the opening 11. The fully symmetrically constructed inking ribbon cassette 1 comprises a respective viewing slot 15 at each of its sides which proceeds radially relative to one of the ribbon winding hubs, the available ribbon supply being capable of being read thereat. Further, a plurality of catch noses 16 distributed over the circumference of the inking ribbon cassette 1 are provided in the joining plane between the two housing shells in order to be able to adequately fix the inking ribbon cassette 1 in the printing position.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. In a printing device including a printer head, a capstan-type ink-ribbon drive, and a ribbon-end monitor, an ink ribbon cassette reversible between a first position and a second position, said cassette comprising the following:

- a substantially rectangular housing composed of two halves, each having two relatively long longitudinal edges and two shorter lateral edges;
- two ribbon winding hubs between which said ink-ribbon is conveyable along a conveying path;
- a pair of printer-head openings extending through one of said longitudinal edges into said conveying path and symmetrically disposed about a centerline of said cassette, so that said printer head is disposed inside of said conveying path when said cassette is mounted in said printing device;
- two capstan/monitor opening means for receiving said capstan drive when said cassette is mounted in one of said positions, and for receiving said ribbon-end monitor when said cassette is mounted in the other of said positions, and disposed symmetrically opposite one another, one at each of said two shorter lateral edges; and said capstan/monitor opening means extending into said conveying path.

2. An inking ribbon cassette according to claim 1, wherein a plurality of catch elements are provided in a joining plane of the two housing halves.

3. An inking ribbon cassette according to claim 1, wherein at least one viewing slot proceeding radially relative to one of the ribbon winding hubs is provided on each of the two halves of the cassette.

4. An ink ribbon cassette according to claim 1, wherein said capstan/monitor openings are fashioned as U-shaped slots.

* * * * *